US006019537A

United States Patent [19]

Hunt

[11] Patent Number: 6,019,537

[45] Date of Patent: Feb. 1, 2000

[54] ACCESSORY CLEANING SYSTEM FOR KITCHEN FAUCET HOSE SPRAY

[76] Inventor: Charles Timothy Hunt, 703 Carolina Ave., Apt. 7-C, New Bern, N.C. 28262

[21] Appl. No.: 09/166,741

[22] Filed: Oct. 5, 1998

[51] Int. Cl.[7] ..... A47L 17/00; A47L 17/04

[52] U.S. Cl. ..... 401/203; 401/42; 401/204; 401/207; 401/289; 401/290

[58] Field of Search ..... 401/289, 290, 401/207, 203, 204, 42, 43, 46

[56] References Cited

U.S. PATENT DOCUMENTS

| | | | |
|---|---|---|---|
| 1,217,597 | 2/1917 | Hecht et al. | 401/42 |
| 1,534,300 | 4/1925 | Coltrane | 401/203 |
| 2,241,443 | 5/1941 | Berry | 401/203 |
| 2,266,902 | 12/1941 | Perkins | 401/43 X |
| 2,652,850 | 9/1953 | Manville | 401/46 X |
| 4,812,070 | 3/1989 | Marty | 401/289 |

FOREIGN PATENT DOCUMENTS

| | | | |
|---|---|---|---|
| 3013495 | 10/1981 | Germany | 401/289 |
| 3530402 | 6/1986 | Germany | 401/207 |
| 9218250 | 10/1992 | WIPO | 401/289 |

*Primary Examiner*—Steven A. Bratlie
*Attorney, Agent, or Firm*—Mills Law Firm

[57] ABSTRACT

An improved hand-held hose spray for kitchen faucets includes interchangeable cleaning accessories for providing scouring, scrubbing, wiping and rinsing functions in the cleansing of kitchen articles and utensils concurrent with the operation and manipulation of the hose spray, eliminating the need for the user to release or replace the hose spray during the cleansing cycle.

11 Claims, 3 Drawing Sheets

ACCESSORY CLEANING SYSTEM FOR KITCHEN FAUCET HOSE SPRAY

FIELD OF THE INVENTION

The present invention relates to cleaning units for kitchen goods and, in particular, an accessory cleaning system for the hand-held hose spray on a kitchen sink faucet having interchangeable cleaning accessories for providing scouring, scrubbing, wiping and rinsing functions in the cleansing of kitchen utensils.

BACKGROUND OF THE INVENTION

The cleaning of soiled utensils and article resulting from food preparation and serving remains a time consuming task notwithstanding the advent of modern conveniences. Even with the wide-spread availability of automatic dishwashers, many articles and utensils soiled during food preparation and serving contain residues, adhered matters, films and the like that need to be removed before washing. Conventionally such deposits are removed in a number of ways.

Lightly adhered matter may often be removed simply by direct rinsing from the kitchen faucet. Other such matter may require more powerful and directed spraying and rinsing. Commonly, the kitchen sink is provided with a manually operable hose spray. Such sprays are normally stowed adjacent the faucet and are connected to the faucet water supply by an extendable hose. The hand spray may be manipulated to deliver a forceful spray pattern on the areas to be cleaned or rinsed. However, not all such adhered matter may be removed by the hand spray and resort must be made to other cleaning devices for removing more resistant deposits, stains, films and the like.

Wiping cloths, sponges and pads are commonly used as an adjunct to rinsing and spraying. If such operations are required in the event that spraying is insufficient, the hand spray must be stored or released before wiping. Thereafter, it is generally desired to provide further rinsing with the hose spray, requiring reextending and operating the unit. Should such wiping be insufficient for more tightly adhered matter, a more powerful cleaning technique such as scrubbing might be required using a brush or like cleaning device providing a more powerful scrubbing interface. As in the foregoing wiping, the hose spray must be released or stowed, the article to be cleaned repositioned, the scrubbing conducted, and the hose spray retrieved and used to rinse the articles.

Articles and utensils, such as pots and pans used in the food preparation, may further contain tightly-adhered deposits and residues resistant to the above-described rinsing, wiping and scrubbing techniques. For such desposits, metallic fiber, plastic mesh, or abrasive pads are required to cleanse the surfaces prior to rinsing with the hose spray.

Accordingly, it would be desirable to provide a cleaning system which could utilize the convenience of the hose spray for rinsing and delivering water to the cleaning area, while allowing the hand spray to perform the needed cleansing action for more resistant deposits without releasing and storing the hose spray.

SUMMARY OF THE INVENTION

The present invention overcomes the above noted deficiencies by providing an improved hand-held hose spray for kitchen faucets that utilizes interchangeable cleaning accessories for providing scouring, scrubbing, wiping and rinsing functions in the cleansing of kitchen articles and utensils concurrent with the operation and manipulation of the hose spray, thereby eliminating the need for the user to release or replace the hose spray during the cleansing cycle. Such advantages are achieved providing a scouring adapter which is secured to the head of an existing or manufactured hose spray units in a manner that prevents unloosening or dislodging during cleansing and which permits conventional rinsing with the hose spray nozzle. The adapter is provided with a plurality of projecting prongs adapted to engage a conventional metallic or fiber scouring pad. In the scouring mode, the user may directly manipulate the hose spray with attached scouring pad to dislodge tightly-adhered matter, films and like residue from the articles and utensils to be cleaned. During such scouring mode, the user may also actuate the hose spray to dispense water therein for activating cleansing agents therein or applying water to the scouring interface to assist in the cleansing.

The accessory cleaning system is further provided with a scrubbing brush accessory, which may be removably mounted on the adapter for providing a scrubbing mode. The scrubbing brush accessory is provided with depending flexible bristles around the periphery thereof for dislodging less tightly adhered matter, films and like residue from the articles or utensils to be cleaned directly by manipulating the hose spray. During the scrubbing mode, the user may actuate the hose spray to dispense water to the scrubbing interface to assist in the cleansing.

The accessory cleaning system is further provided with a wiping pad accessory which may be removably mounted on the adapter for providing a soft wiping mode. The wiping pad accessory is provided with a soft foam pad, cloth pad or other like material for removing lightly adhered matter films and the like from the articles or utensils to be cleaned. During the wiping mode, the user may actuate the hose spray to dispense water into the pad and therethrough at the wiping interface to assist in the cleaning.

It will be appreciated that the foregoing accessory cleaning devices greatly simplify the normal kitchen cleansing tasks by providing a system wherein the user may perform all ordinary cleansing functions directly with the hand spray, without the need for releasing and stowing the hand spray during manual scouring, scrubbing and wiping.

Accordingly, it is an object of the present invention to provide an accessory for a kitchen faucet hand spray which permits direct scrubbing, scouring, wiping and rinsing by movement of the hand spray.

It is a further object of the present invention to provide a kitchen faucet hand spray having selectable scouring, scrubbing, wiping and rinsing capabilities.

Yet another object of the present invention is to provide an accessory cleaning unit for a kitchen faucet hand spray that may be removably mounted thereon for performing desired cleansing operations on soiled articles.

A still further object of the present invention is to provide a plurality of cleansing devices which can be coupled to a hand spray for directly performing ordinary cleaning functions concurrently with the application of rinsing water.

BRIEF DESCRIPTION OF THE DRAWING

The above objects, features and advantages of the present invention will become apparent to those skilled in the art upon reading the detailed description of the preferred embodiments, taken in conjunction with accompanying drawings in which.

DESCRIPTION OF THE PREFERRED EMBODIMENTS

Figure 1:
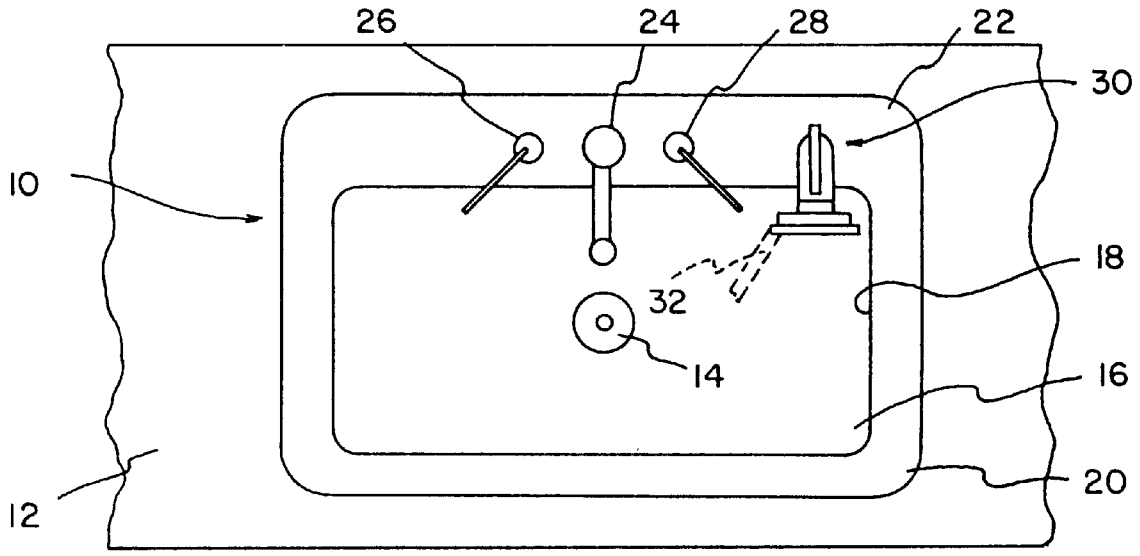
FIG. 1 is a fragmentary plan view of a kitchen counter having a sink provided with a faucet unit including a hose spray in accordance with the present invention.

Referring to FIG. 1 for purposes of describing a preferred embodiment of the present invention, there is shown a kitchen sink 10 conventionally mounted on a raised counter 12. The sink 10 is provided with a drain 14 mounted in the base 16 of a recessed tub 18. The sink 10 includes a top peripheral flange 20 surrounding the tub 18. The rearward side 22 of the flange 20 is provided with an upwardly projecting, pivotally forwardly extending faucet 24 for dispensing water into the tub 18 as controlled conventionally by faucet handles 26, 28 for delivering hot and cold water, or a mixture thereof, through the faucet 24. The sink 10 is also provided with a spray unit 30 connected by an extendable hose 32 for dispensing water therethrough as controlled by valving associated with the handles 26,28. The spray unit 30 includes or is adapted to accept an accessory cleaning system providing a plurality of common kitchen cleaning functions as described in greater detail below.

It will be appreciated that the present invention may be incorporated in all conventionally available sink and faucet designs including or adapted to include, conventional hand-held spray units.

Figure 2:
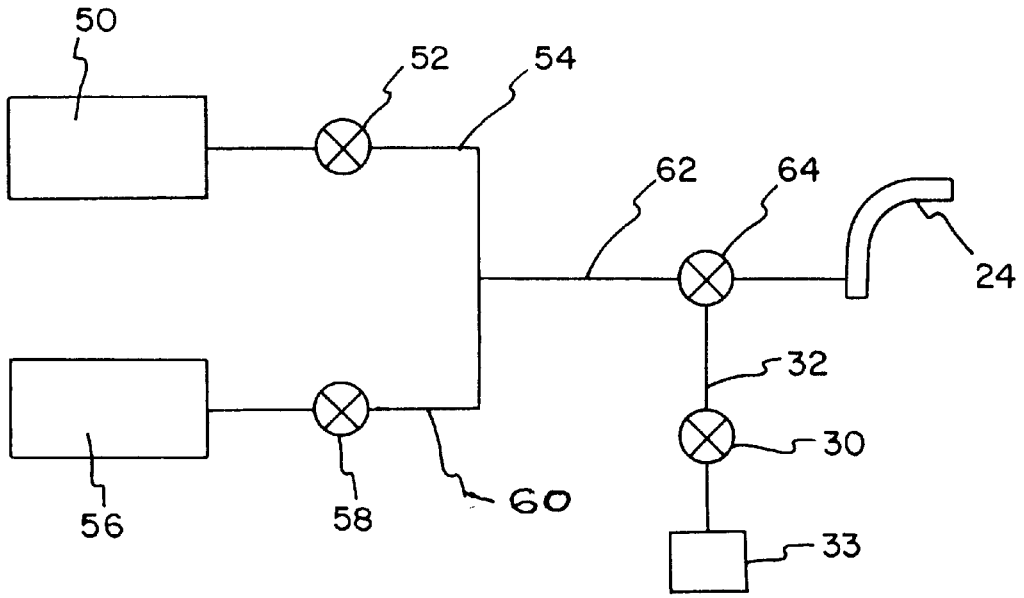
FIG. 2 is a schematic diagram of the faucet unit including the hose spray.

Referring to FIG. 2, there is shown the schematic flow diagram for a typical installation. Therein, the cold-water supply 50 is fluidly connected to a cold water valve 52 at the handle 28 by line 54. The house hot-water supply 56 is fluidly connected to a hot water valve 58 at the faucet handle 26 by line 60. The lines 54,60 are commonly connected to line 62 terminating at the faucet 24 and having a valve 64 interposed therein. The valve 64 is connected to the hose 32 leading to the spray unit 30. The spray unit 30 includes a hand operated internal valve operative to cause the valve 64 to switch positions to divert water flow from the faucet to the hose and accordingly deliver water to the hand spray 30 at a temperature and flow rate determined by the setting of the valves 52,58. While the foregoing has been described with reference to a two-handled faucet it will be appreciated that the spray unit is also compatible with conventional single handle designs.

Figure 3:
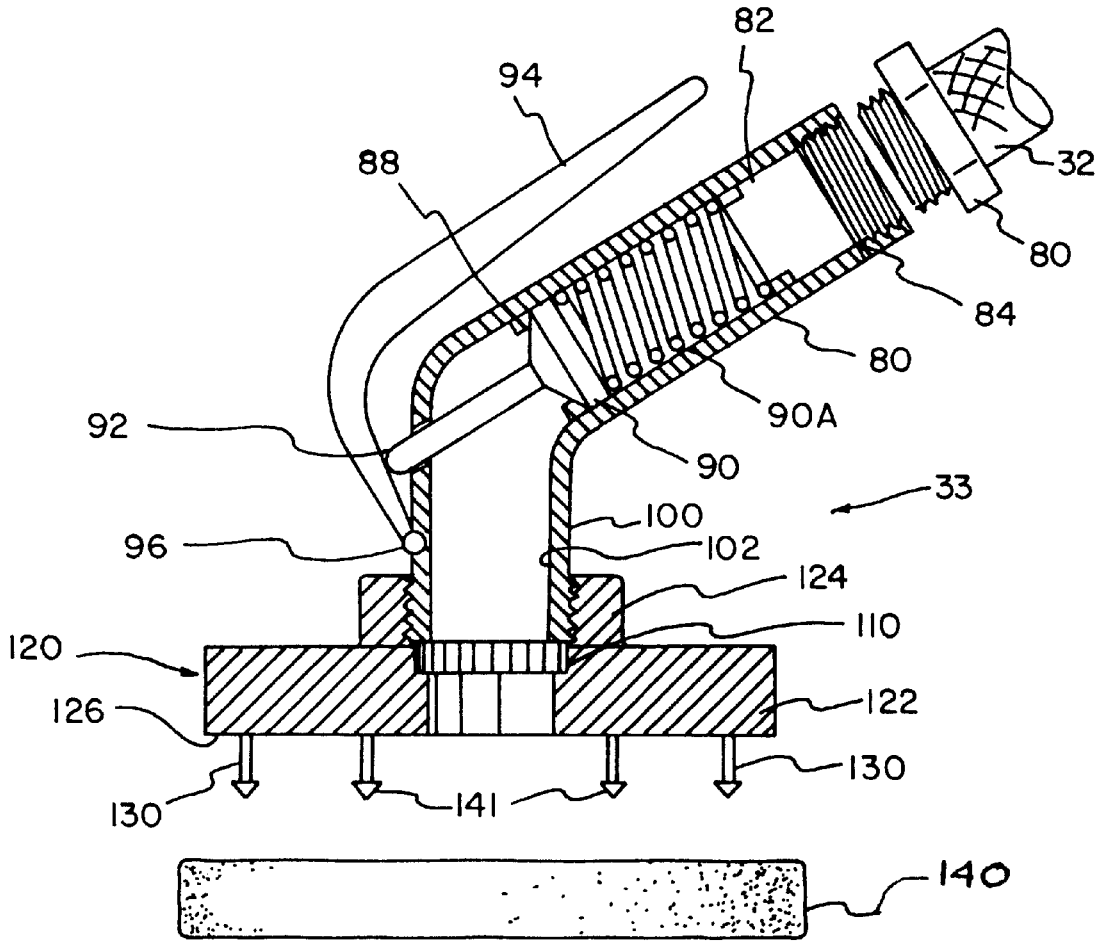
FIG. 3 is a partially sectioned side elevational view of the hose spray in accordance with the present invention including the scouring adapter operatively engaging a scouring pad.

Referring to FIG. 3. the accessory unit 33 permits the spray unit to provide cleansing, scrubbing, wiping and scouring functions directly on objects to be cleaned, in addition to providing the conventional rinsing functions. The spray unit 30 typically includes an elongated body 80 having a central flow passage 82 formed therein and rearwardly terminating at an interiorally threaded section 84 to which the threaded terminal nut 86 of the hose 32 is threadedly connected to fluidly connect the hose 32 with the flow passage 82. The passage 82 includes a central valve seat 88. A valve 90(*a*) engages the valve seat 88 as biased by a coiled spring 90. A valve rod 92 connected to the valve 90 projects outwardly of the body 80 and is connected to an operating handle 94 pivotally connected to the body 80 at connection 96.

The hand spray 30 further includes a generally cylindrical head section 100 disposed at an angle to the main body 80. The head section 100 includes an interior flow passage 102 fluidly communicating with passage 82 at the seat 88. The head section 100 includes an apertured distribution nozzle 110 suitably fixedly or removably connected thereto at the lower end thereof. Accordingly in operation the hand spray 30 functions in a conventional manner to provide a directed rinsing spray for kitchen articles and utensils to be cleaned. More particularly, an operator removes the spray 30 from its nested position on the sink flange and locates the unit at a desired position as accommodated by the extendable hose 32. As desired, the operator depresses the lever 94 to open the internal valve 90 which in turn switches the line valve 64 to direct a rinsing spray serially through hose 32, passage 82, passage 102 and outwardly through the apertures in the nozzle 110.

Figure 6:
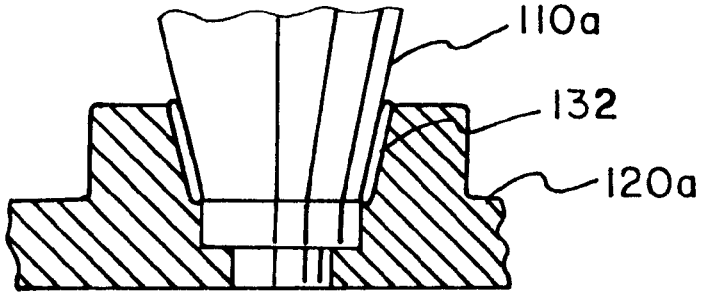
FIG. 6 is a fragmentary cross section view of an alternative coupling of the spray unit to the cleansing accessory.

The accessory unit 33 is adapted to be provided as an integral feature of the hose spray 30, as shown in FIG. 3, or as an retrofit accessory as shown in FIG. 6. The lower end of the head section 100 is provided with an exterior threaded portion for connection with the unit 33. The accessory unit 33 is provided with a generally cylindrical adapter 120. The base 120 includes a circular flange 122 having a projecting hub 124. The flange 122 and the hub 124 are centrally apertured to define a flow opening substantially the size of the nozzle 1 10 such that, for rinsing functions, water flows through the unit substantially without obstruction. The upper end of the hub 124 is interiorly threaded for connection to the exterior thread of the head section 100 thereby functionally integrating the adapter with the spray unit 30. The lower surface 126 is provided with a plurality of spaced downwardly projecting prongs 130. The prongs 130 are adapted to engage a scouring pad 140, of conventional metallic fiber or plastic mesh construction, to thereby permit the pad to be abrasively manipulated directly against the article to be cleaned while selectively dispensing water therethrough. To provide for more secure gripping of the scouring pad 140, the prongs may be provided with flared barb-like surfaces 141 that resist separation of the pad 140 from the adapter under water flow conditions.

The attachment of the adapter 120 to the head section 110 should be secure enough that loosening of the adapter during normal scouring motions is effectively resisted. Accordingly, it will be appreciated that many similar mountings may be provided. For instance, as shown in FIG. 6, the terminal end of the head section 100*a* may be received within a complementary shaped counterbore in the adapter 120*a* and secured thereto by a suitable adhesive 132, or the like. Other mechanical locking systems may be employed; however, each should be resistant to the forces applied thereto during operation. In this regard, mere compressive joints and interlocking rib and groove connections may be unsatisfactory.

The prongs 130 may be provided in various arrays. The prongs 130 may be circumferentially disposed about the periphery of the flange 122 leaving the entire center of the adapter 120 unobstructed to the water flow during rinsing operations. The prongs 130 may also be disposed in rows or randomly over the lower surface. In any event the prongs should provide a plurality of engagements with the scouring pad 140 to securely retain the pad on the adapter during operation. The prongs should also be relatively shallow, preferably less than ½ inch, and most preferably less than ¼ inch so as to provide secure gripping of the pad 140 without deeply penetrating the pad in a manner which would adversely affect normal scouring action while accommodating normal wear of the pad material. The prongs should also be relatively small in diameter, preferably ¼ inch or less, such that the pad is penetrated by the prongs rather than compressed.

In operation with the adapter 120 mounted on the hose spray, two distinct cleansing modes may be effected. First, normal rinsing may conventionally provided by extending the hand spray 30 from its stowed position on the sink 14, actuating the lever 94, and directing the resultant water spray as desired. Second, a scouring mode may be provided by engaging the adapter prongs 130 with the desired scouring pad and directing the scouring motions to dislodge and remove resistant deposits on the kitchen articles and utensils. During such scouring the spray unit may be actuated to direct water onto the pad to wet the same and activate the cleansing agents therewithin. Upon completion, the pad may be removed and final rinsing provided by conventional water spray.

Figure 4:
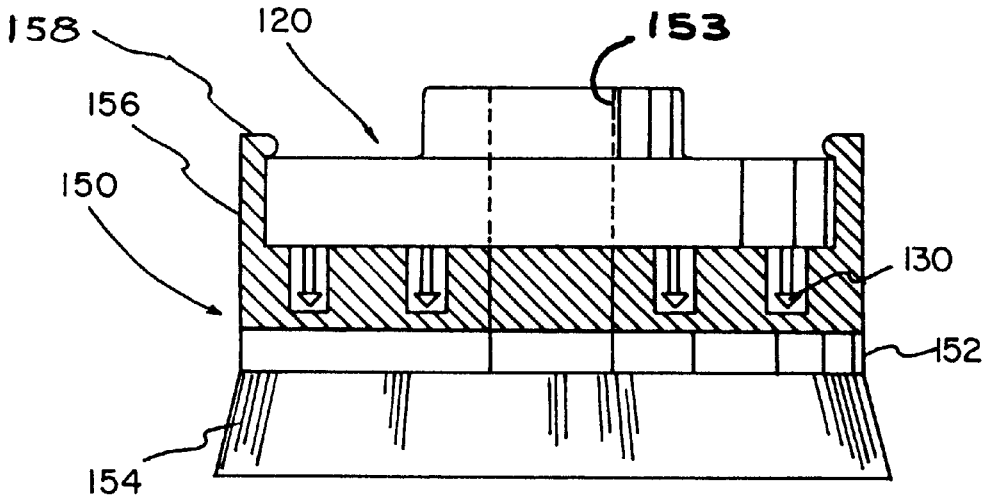
FIG. 4 is a cross sectional view of the scouring adapter provided with a scrubbing brush accessory.

Referring to FIG. 4, a brush based scrubbing action may be added to the hand spray 30 with an scrubbing brush accessory 150 which it adapted to be removably connected to the adapter 120. More particularly, the brush 150 accessory includes a cylindrical base 152 having a central aperture 153 formed therein fluidly communicating with the central passage in the adapter 33 providing water flow from the nozzle 110. A scrubbing brush 154 comprised of circumferential array of short bristles is adhesively or mechanically attached at the lower surface of the base 152. A cylindrical rim 156 extends upwardly from the top surface of the base 152 and terminates with a radially inwardly annular lip 158 thereby defining a counterbore having a diameter and depth for slidably receiving the adapter 120. The brush accessory 150 is preferably formed of a material with sufficient flexibility to permit the lip 158 and rim 156 to outwardly deflect to accept insertion of the adapter base and contract thereafter to securely capture the adapter and provide a mechanical coupling resisting separation thereof during normal scrubbing operations. The bristles for the brush are preferably selected to have a length, density and flexibility to remove large, lightly adhered particulates from the surfaces of the articles and utensils being cleaned using normal scrubbing movements. Concurrently therewith the hand spray 30 may be actuated as desired to provide rinsing.

While the scrubbing brush has been described by reference to mounting on the adapter, it is apparent that the scrubbing brush could be directly mounted on the hand spray 30 in a manner similar to the mounting of the adapter 33 on the head section 100.

Figure 5:
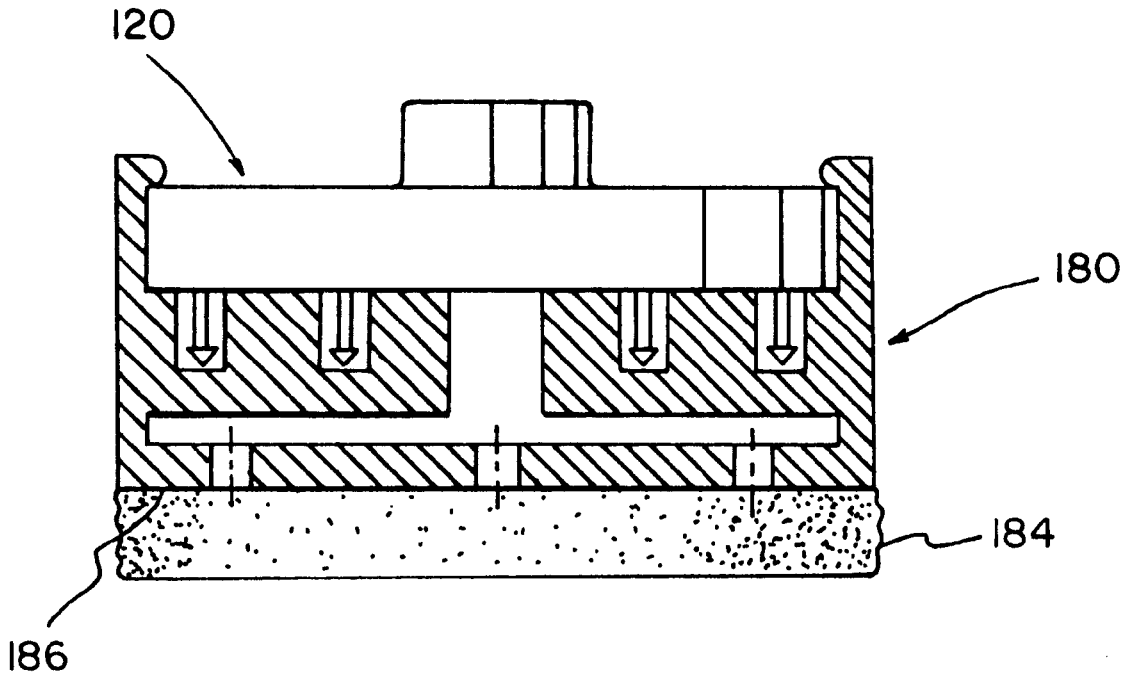
FIG. 5 is a view similar to FIG. 4 showing the scouring adapter provided with a wiping pad accessory.

Referring to FIG. 5, there is shown wiping pad accessory 180 for removing lightly adhered particulates and films from the surfaces of soiled articles and utensils with a low pressure wiping action. The wiping pad accessory includes a base 182 having a configuration and removably connected to the adapter 120 in a manner structurally similar to the scrubbing brush accessory 150. A soft, porous circular wiping pad 184 is adhesively or mechanically secured to the bottom surface of the base 186. Any suitable material may be utilized for this purpose, such as polymeric foams or woven fabrics or the like. In operation, the user manipulates the accessory over the article to be cleaned, dispensing additional water from the hand spray as desired.

With each of the foregoing accessories, it will be appreciated that the user may accomplish scouring, scrubbing, wiping and rinsing without ceasing the cleansing operation to retrieve the hand spray for applying water to the cleansing interface. The ability to apply sufficient water, without interruption, during the cleaning simplifies and reduces the time and complexity of cleaning from the most heavily soiled articles to those requiring only modest efforts.

The foregoing present invention has been shown and described herein with reference to what is considered practical and preferred embodiments. It will be recognized however that departures may be made therefrom within the scope of the invention and that obvious modifications will occur to persons skilled in the art.

What is claimed:

1. An accessory cleaning system for an extendable hose spray for a kitchen faucet, the hose spray having a body member including a fluid conduit therethrough having one end connected to a hose member fluidly connected with a water supply and another end terminating with an apertured nozzle for directing a water spray outwardly thereof as controlled by a manually actuated valve operably disposed in said conduit, said accessory cleaning system comprising: an adapter member secured at a first end to the body member of the hose spray adjacent said nozzle and having a central fluid passage therein fluidly communicating with said nozzle and permitting the water spray therethrough, said adapter member having an annular surface at said another end; a plurality of projecting prong members extending axially from annular surface transverse to said nozzle having a number, length and cross section adapted to penetrate and secure thereto a fibrous scouring device effective for removing tightly adhered matter on articles and utensils to be cleaned, said adapter member being adapted to removably receive thereon a supplemental cleaning device.

2. The cleaning system as recited in claim 1 wherein said prongs are adapted to engage a metallic fiber pad.

3. The cleaning system as recited in claim 2 wherein said prong members are provided with barb means for resisting separation of said scouring device from said adapter member.

4. The cleaning system as recited in claim 1 wherein said supplemental cleaning device is selected from the group consisting of an accessory member including a scrubbing device including a cleaning brush and a wiping member carrying a resilient pad.

5. The cleaning system as recited in claim 1 wherein said adapter member includes an annular hub for telescopically receiving said another end of said body member including means for tightly securing said adapter member to said body member.

6. The cleaning system as recited in claim 5 wherein said means for tightly securing is a threaded connection.

7. The cleaning system as recited in claim 5 wherein said means for tightly securing is an adhesive connection.

8. The cleaning system as recited in claim 5 wherein said means for tightly securing is a releasable mechanical connection.

9. An accessory cleaning system for an extendable hose spray for a kitchen faucet, the hose spray having a body member including a fluid conduit therethrough having one end connected to a hose member fluidly connected with a water supply and another end terminating with an apertured nozzle for directing a water spray outwardly thereof as controlled by a manually actuated valve operably disposed in said conduit, said accessory cleaning system comprising: an adapter member secured at a first end to the body member of the hose spray adjacent said nozzle and having a central fluid passage therein fluidly communicating with said nozzle and permitting the water spray therethrough, said adapter member having an annular surface at said another end; a plurality of projecting prong members extending from annular surface and aligned with said central fluid passage having a number, length and cross section adapted to penetrate and secure thereto a fibrous scouring device effective for removing tightly adhered matter on articles and utensils to be cleaned, said adapter member being adapted to removably receive thereon a supplemental cleaning device.

10. A hand spray for a kitchen faucet for cleaning soiled articles and utensil containing adhered residues, comprising: a spray body having an internal passage for fluid connection at one end with a water supply and terminating at another end with apertured nozzle means for directing water outwardly thereof; manually controlled valve means in said passage for opening and closing said passage; an adapter member operatively connected to said spray body and having a flow passage communicating with said nozzle means; a plurality of projecting prong members on said adapter member aligned with said flow passage adapted to mechanically grip a scouring member; and at least one accessory cleaning device provided with an auxiliary cleaning surface adapted to be releasable carried by said adapter member for performing auxiliary cleaning function having a flow passage communicating with said nozzle means and effective for delivering water from said nozzle means onto said auxiliary cleaning surface.

11. A method for providing auxiliary cleaning function with a hand held kitchen faucet hose spray having an outlet nozzle for rinsing soiled items, comprising the steps of:

a. attaching an adapter member to said hose spray with a flow passage communicating with said nozzle not substantially affecting operation of said nozzle;

b. providing projecting attaching members on said adapter member aligned with said flow passage for mechanically attaching a scouring material thereto;

c. providing an auxiliary cleaning device having a material for cleaning said soiled items; and d. releasably attaching said auxiliary cleaning device to said adapter member.

* * * * *